US010632531B2

(12) United States Patent
Grandin et al.

(10) Patent No.: US 10,632,531 B2
(45) Date of Patent: Apr. 28, 2020

(54) KNOCKOUT METHOD AND MACHINE FOR A CLUSTER OF LOST-PATTERN CASTINGS

(71) Applicant: SAFRAN AIRCRAFT ENGINES, Paris (FR)

(72) Inventors: Alain Grandin, Moissy-cramayel (FR); Vincent Auffret, Moissy-cramayel (FR); Jean-Claude Del Re, Moissy-cramayel (FR); Arnaud Jean-Bart, Moissy-cramayel (FR); Gabriel Saunier, Moissy-cramayel (FR); Jean-Pierre Vincette, Moissy-cramayel (FR)

(73) Assignee: Safran Aircraft Engines, Paris (FR)

( * ) Notice: Subject to any disclaimer, the term of this patent is extended or adjusted under 35 U.S.C. 154(b) by 212 days.

(21) Appl. No.: 15/546,545

(22) PCT Filed: Jan. 11, 2016

(86) PCT No.: PCT/FR2016/050039

§ 371 (c)(1),
(2) Date: Jul. 26, 2017

(87) PCT Pub. No.: WO2016/120538

PCT Pub. Date: Aug. 4, 2016

(65) Prior Publication Data

US 2018/0178280 A1 Jun. 28, 2018

(30) Foreign Application Priority Data

Jan. 27, 2015 (FR) ..... 15 50595

(51) Int. Cl.
*B22D 29/00* (2006.01)
*B22C 7/02* (2006.01)

(52) U.S. Cl.
CPC ..... *B22D 29/00* (2013.01); *B22C 7/02* (2013.01)

(58) Field of Classification Search
CPC ..... B22D 29/00; B22D 29/04; B22D 29/06; B22D 29/08; B22C 7/02
See application file for complete search history.

(56) References Cited

U.S. PATENT DOCUMENTS 471,158 A * 3/1892 Westerman ..... A23N 4/14 99/545

FOREIGN PATENT DOCUMENTS

DE 102005055877 A1 7/2006
EP 0922514 A2 6/1999
(Continued)

OTHER PUBLICATIONS

International Search Report and English language translation issued in International App. No. PCT/FR2016/050039 dated Apr. 13, 2016 (4 pages).

*Primary Examiner* — Kevin P Kerns
*Assistant Examiner* — Steven S Ha
(74) *Attorney, Agent, or Firm* — Bookoff McAndrews, PLLC

(57) ABSTRACT

A knockout method for knocking out a cluster (30) of lost-pattern metal castings (32), the cluster of castings being formed in a shell (1), wherein at least one knife is moved by means of a machine without making contact with the cluster in such a manner that the knife engages the shell, breaks it into a plurality of fragments, and detaches at least a portion of the shell from the cluster; a machine for performing the method.

12 Claims, 8 Drawing Sheets

(56) References Cited

FOREIGN PATENT DOCUMENTS

| | | | |
|---|---|---|---|
| FR | 2460736 | A1 | 1/1981 |
| WO | 2014049223 | A2 | 4/2014 |

* cited by examiner

KNOCKOUT METHOD AND MACHINE FOR A CLUSTER OF LOST-PATTERN CASTINGS

CROSS-REFERENCE TO RELATED APPLICATIONS

This application is the U.S. national phase entry under 35 U.S.C. § 371 of International Application No. PCT/FR2016/050039, filed on Jan. 11, 2016, which claims priority to French Patent Application No. 1550595, filed on Jan. 27, 2015, the entireties of which are herein incorporated by reference.

FIELD OF THE INVENTION

The invention relates to knocking out clusters of lost-pattern metal castings.

BACKGROUND

The lost-pattern (or lost wax) casting method is a well-known casting method that is used in particular for fabricating turbine blades, in particular for aeroengines, in particular gas turbine engines. By way of example, the method is described in Document WO 2014/049223.

When performing that casting method to fabricate a cluster of castings, a cluster of castings is obtained that is formed in an "investment" or shell. This shell is typically made of ceramic. It is referred to herein either as a "shell" or as a "shell mold".

In order to finalize fabrication of castings, it is therefore necessary to extract them: this operation is known as "knocking out".

Traditionally, knocking out is performed by knocking against the shell with a hammer so as to break it and detach it from the cluster of castings.

That technique nevertheless suffers from two drawbacks: firstly, it is tedious and tiring for the operators performing those operations; and secondly it can lead to mechanical stresses in the castings. During subsequent heat treatment, such mechanical stresses can give rise to the appearance of metallurgical defects known as "recrystallized grains". Such grains of recrystallized metal are zones of weakness that reduce the lifetime of the parts that are obtained and that can lead to them being rejected.

SUMMARY OF THE INVENTION

The object of the invention is to propose a knockout method for clusters of lost-pattern metal castings, in which the two above-mentioned drawbacks are eliminated, or at least reduced.

According to the invention, this object is achieved by a knockout method for knocking out a cluster of lost-pattern metal castings, the cluster of castings being formed in a shell, wherein at least one knife is moved by means of a machine without making contact with the cluster in such a manner that the knife engages the shell, breaks it into a plurality of fragments, and detaches at least a portion of the shell from the cluster. The term "knife" is used to mean a tool surface designed to engage an external body, and in particular in the present situation the shell of the cluster.

Below, in order to simplify explanation, the description refers to "a" knife; nevertheless, it should be understood that the explanations also cover the situation in which the method is performed with a plurality of knockout knives.

In the method of the invention described above, the movement of the knife (or knives) for knocking out the cluster of castings preferably takes place at a speed that is slow; for example a speed of less than 0.2 meters per second (m/s) or indeed less than 0.05 m/s. This thus reduces the impact between the knife and the shell and reduces the risk of the castings being degraded.

Optionally, the invention may be performed without any impact against the shell; that is to say on first contact between the knife (or knives) and the shell, the speed of the knives is practically zero.

Conversely, in another implementation, the knockout knife (or knives) may move without stopping. The travel speed of the knife (or knives) may for example be substantially constant.

Advantageously, in the absence of impact at high speed between the knife and the shell, there is no formation of stress starters where recrystallized grains might appear during heat treatment applied to the castings.

The method is performed by means of a machine in order to ensure that the knife (or knives) move(s) under the specified conditions (in particular no contact with the cluster in the vicinity of the castings). The machine advantageously avoids the tiring operation of knocking out clusters with a hammer.

The effectiveness of the method results from the fact that the shell formed around the castings is a fragile part with relatively little adhesion to the castings constituting the cluster. Also advantageously, even if the knife (or knives) of the tooling do not make contact with all of the portions of the shell (far from it), by engaging certain projecting portions or "protuberances" of the shell they succeed in breaking the shell almost completely, thereby knocking out the castings.

The projecting portions or protuberances via which the shell mold is broken may for example be formed around a heat shield provided in the shell mold.

Such a heat shield serves to improve the cooling of the cluster during and after casting (an example of a heat shield is described in Document FR 2 874 340). It serves in particular to keep the solidification front as horizontal as possible (i.e. to keep the solid/liquid interface during cooling of the cluster of castings in the mold as horizontal as possible).

Since the knife (or knives) engage(s) the protuberances of the shell mold, and only its protuberances (excluding the cluster itself), there is therefore no need for the knife to come close to the castings that are to be knocked out. On the contrary, in order to reduce the mechanical stresses applied to the surfaces of the castings to as little as possible, it is even preferable for the movement of the knife and its contact with the shell to take place at a certain distance away from the castings.

Because of these relatively easy requirements, the method of the invention may advantageously be performed with a knife (or knives) and/or with movements of the knife (or knives) that are extremely simple.

Thus, as mentioned above, the speed of the knife may optionally be constant.

Advantageously, in an implementation of the method, the movement of said at least one knife for knocking out the cluster of castings is constituted solely by a movement in translation. This movement may in particular be carried out in a direction parallel to the axis of the cluster (the casting axis, or axis of symmetry of the cluster). This axis generally extends vertically while the cluster is being cast.

Nevertheless, in other implementations of the invention, this movement of said at least one knife may equally well comprise movement that is not parallel to the axis of the cluster, e.g. a movement in rotation. It may thus optionally be constituted solely by a movement in rotation.

More generally, the movement may be any kind of movement, as a function of the capabilities of the machine on which the knife is fastened (number of degrees of freedom and number of axes), and as a function of the shape of the cluster.

In an implementation, the movement of said at least one knife comprises passing between every pair of adjacent castings among said castings. Specifically, for a pair of adjacent castings, passing a knife between the two castings of the pair of adjacent castings makes it possible to ensure that the portion of the shell potentially connecting together these castings is broken, thereby facilitating separation of the shell from the cluster.

In particular, when the parts of the cluster are distributed around a casting axis, the parts are arranged in a circle around the casting axis. They are then adjacent in pairs around the circumference of said circle.

In an implementation, said at least one knife is constituted by a plurality of knives, and during the movement of said plurality of knives, all of said knives come into contact with the shell at substantially the same time. This makes it possible to detach the shell more effectively from the cluster.

In addition, the invention also provides a method of fabricating castings, the method comprising the following steps: fabricating a cluster of lost-pattern castings, the cluster of castings being formed in a shell, then knocking out at least a portion of the shell by the above-defined method of knocking out a cluster of castings.

In addition, the invention also provides a knockout machine for knocking out a cluster of lost-pattern castings, the cluster of castings being formed in a shell, the machine comprising:

a frame having means for rigidly fastening the shell to the frame;

at least one knife; and at least one actuator suitable for moving said at least one knife relative to the frame in a space provided for fastening the cluster.

Preferably, the actuator is designed to move said at least one knife relative to the frame in the space provided for fastening the cluster at a speed of less than 0.2 m/s, or indeed less than 0.05 m/s.

The machine may be a relatively simple press.

The actuator(s) may include an actuator suitable for moving at least one blade for knocking out the cluster of castings solely by a movement in translation or solely by a movement in rotation.

The actuator(s) may in particular comprise a jack. The jack can move said at least one knife, in particular in translation.

Said at least one knife is preferably not rotatable (i.e. it is not a drill bit nor a milling cutter).

In an embodiment, said at least one knife is constituted by a plurality of knives incorporated in a single tool.

The knives may also be rigidly fastened to one another within the tool.

In particular, they may extend in directions that are substantially perpendicular to the travel direction of the tool.

In particular, they may occupy a common plane.

In particular, they may be elongate and formed on portions of a tool, e.g. in the form of fingers, that are directed in directions that are radial relative to the center of the tool.

The machine is designed for knocking out a cluster of castings formed in a shell.

Consequently, the actuator(s) is/are designed, as a function of the configuration of the cluster, so as to move the knife (or knives) without impact relative to the cluster and without contact with the blades in order to separate at least a portion of the shell from the cluster.

Consequently, the invention also provides an assembly comprising a knockout machine as defined above and a cluster of lost-pattern castings, the cluster of castings being formed in a shell; the knockout machine is suitable for enabling said cluster to be fastened to the frame; and said at least one actuator is suitable, when the cluster is fastened to the frame, for moving said at least one knife relative to the cluster and without making contact with the cluster in such a manner that said at least one knife engages the shell, it breaks the shell into a plurality of fragments, and detaches at least a portion of the shell from the cluster.

In an embodiment, the shell includes at least one protuberance in the vicinity of each casting of the cluster, and said at least one knife engages the protuberance during said movement. This or these protuberances constitute one or more portions of the shell that do not contain any portions of the cluster; thus, the knife (or knives) can engage the protuberance(s) without any risk of striking the cluster.

The or each protuberance preferably lies at least 6 millimeters (mm) and preferably at least 8 mm from the casting in the vicinity of which it is located.

In an embodiment, at least one of the protuberances surrounds at least one of the castings of the cluster over 360° when seen looking along the axis of the cluster. The protuberance may in particular be a heat shield serving to improve the cooling of the cluster during casting and cooling of the metal.

In an embodiment, said protuberances are arranged substantially in a plane.

In an embodiment, at least some of the protuberances are formed around or from a part in the form of a plate perforated by holes.

This part is usually designed to form a heat shield.

BRIEF DESCRIPTION OF THE DRAWINGS

The invention can be well understood and its advantages appear better on reading the following detailed description of embodiments given as non-limiting examples. The description refers to the accompanying drawings, in which.

DETAILED DESCRIPTION OF THE INVENTION

An example of a knockout machine and method in a first implementation of the invention is described with reference to FIGS. 1 to 5. The knockout machine and method are described in the context of a method in accordance with the invention for fabricating blades.

Figure 1:
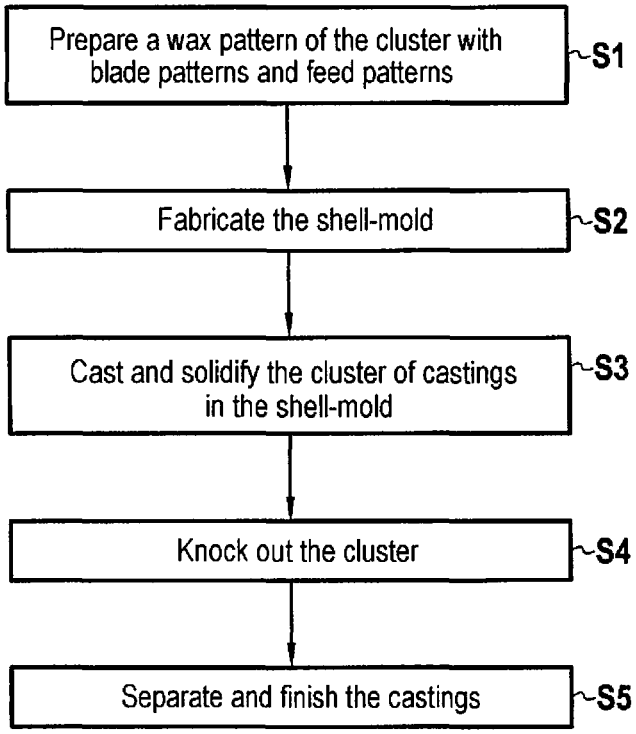
FIG. 1 is a diagram of the steps of a method of the invention for fabricating parts by lost-pattern casting.
Figure 2:
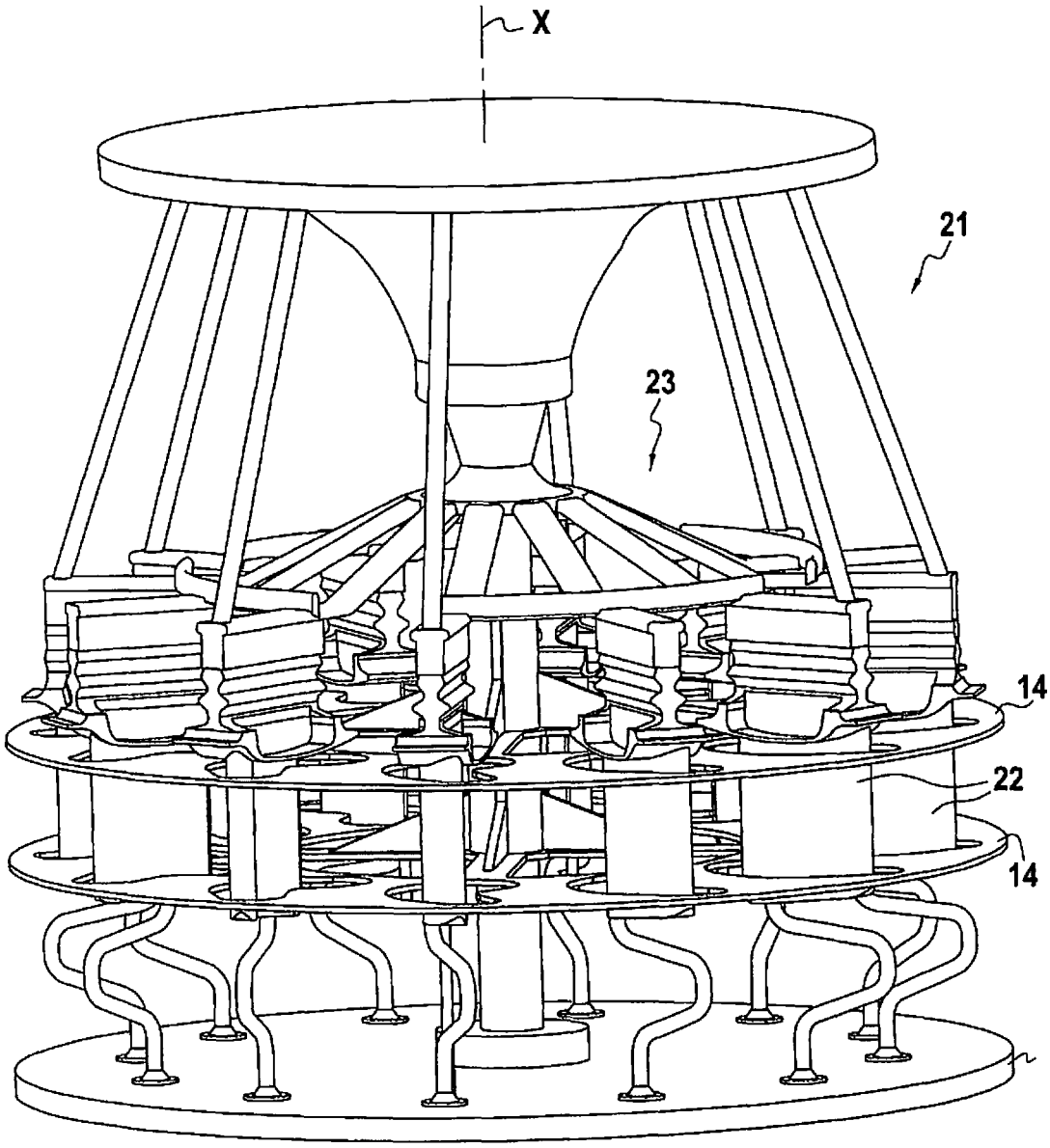
FIG. 2 is a diagram of a wax core suitable for use in performing the FIG. 1 method for fabricating blades.
Figure 3:
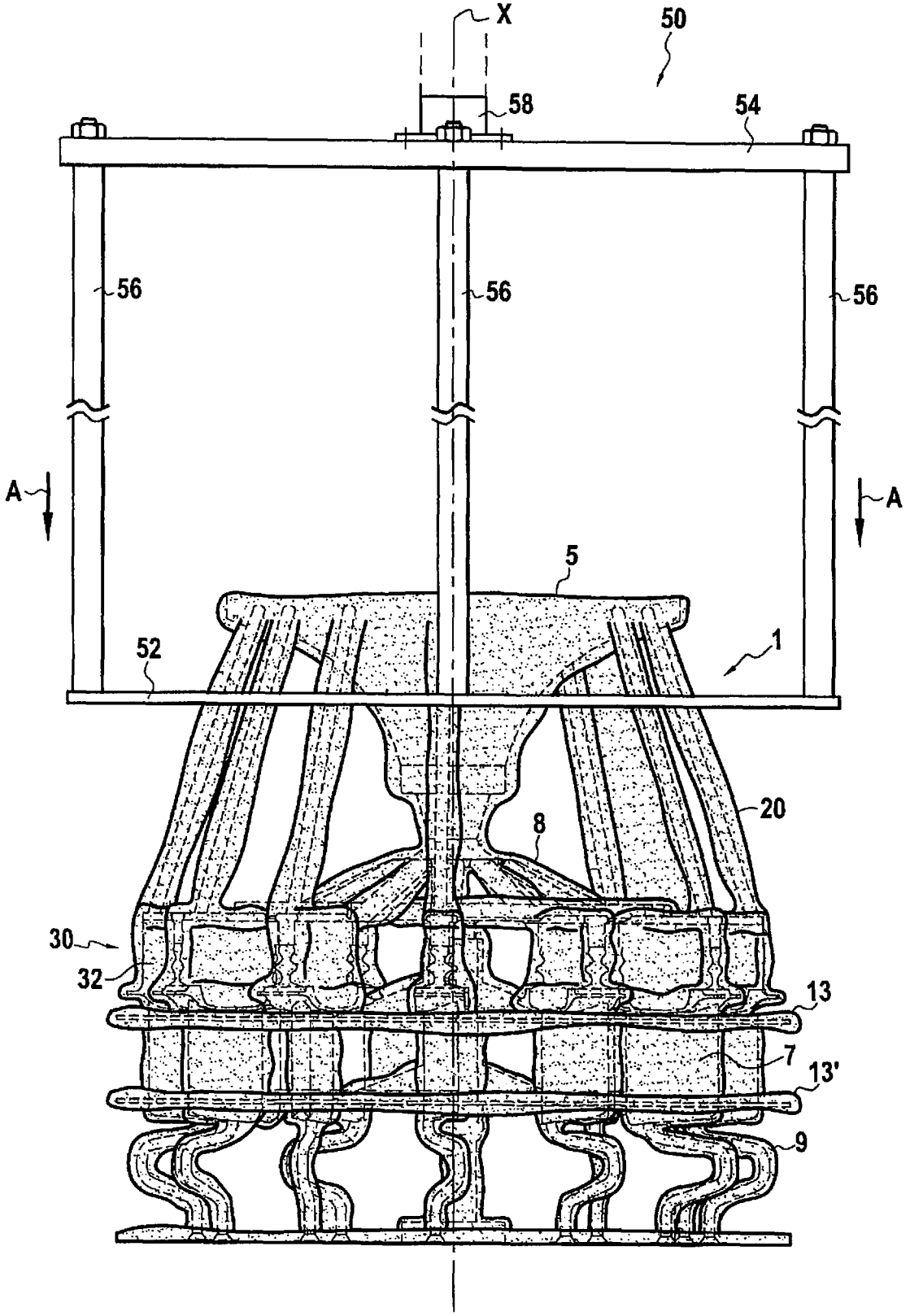
FIG. 3 is a side view of a shell mold and of tooling used in the FIG. 1 method of fabricating blades.

The blade fabrication method described is a lost-pattern casting method (FIG. 1).

The first step S1 of the method consists in fabricating a cluster pattern 21 out of wax (FIG. 2), also referred to as a "non-permanent cluster". Thereafter, a shell mold 1 is made around the wax cluster pattern, in conventional manner.

The cluster pattern 21 comprises a plurality of blade patterns 22 connected together by auxiliary portions 23. These auxiliary portions 23 include two additional parts 14 of disk shape, both made of wax. Each of these additional parts 14 is in the form of a plate pierced by holes through which the blade patterns 22 pass.

The blade patterns 22 are all identical with one another. They are arranged in a circle in axisymmetric manner around an axis X, referred to as the casting axis. The axis X is arranged in a vertical direction during the casting operation when molten metal is cast into the shell mold 1 (an operation that is described in greater detail below).

The blade patterns 22 are arranged parallel to the axis X.

During fabrication of the shell mold 1 (FIG. 2):

- the blade patterns 22 are used to form mold cavities 7 for molding blades 32;
- the additional parts 14 serve to provide a top heat shield 13 and a bottom heat shield 13'; and
- the other functional parts 23 serve in particular to provide a pouring bush 5, feed channels 8, stiffeners 20, and selectors 9.

In a second step S2, the shell mold 1 is made starting with the wax cluster 21 (this step is described in greater detail in Document WO 2014/049223). While making the shell, two additional shell portions are obtained directly from the additional parts 14 added to the cluster pattern 21.

The last operation of step S2 consists in eliminating the wax of the cluster pattern from the mold. The wax is eliminated by placing the shell mold in an autoclave mold (or the like) and raising it to a temperature higher than the melting temperature of the wax.

After this operation of eliminating the wax, the additional shell portions define cavities referred to herein as "additional" cavities.

Two implementations may be envisaged: either the original cavities are in communication with the main cavity comprising the feed tree connected to the cavities formed by the blade patterns 22 (before eliminating the wax), or else the additional cavities are not in communication with the main cavity.

In a third step S3, the cluster 30 of blades 32 is formed in the shell mold 1 by casting molten metal into the shell mold 1.

The result of the casting differs depending on whether or not the additional cavities are connected to the main cavity:

In a first implementation, the additional cavities are not in communication with the main cavity; communication between these cavities and the main cavity may for example be closed off deliberately. These cavities then remain empty during casting and they do not become filled with metal.

In a second implementation, the additional cavities are in communication with the main cavity. They therefore become filled during casting.

In a fourth step S4, after the metal has cooled and solidified in the shell mold 1, the cluster 30 is knocked out from the shell mold 1.

In both implementations, knocking out consists in fragmenting the shell by acting on the additional shell portions. During this step, it is appropriate to avoid any contact with the solidified metal.

Finally, in a fifth step S5, each of the blades 32 is separated from the remainder of the cluster 30 and is finished by various finishing methods, e.g. machining methods.

The invention relates in particular to the knockout method used during the above-mentioned fourth step S4.

Figure 4:
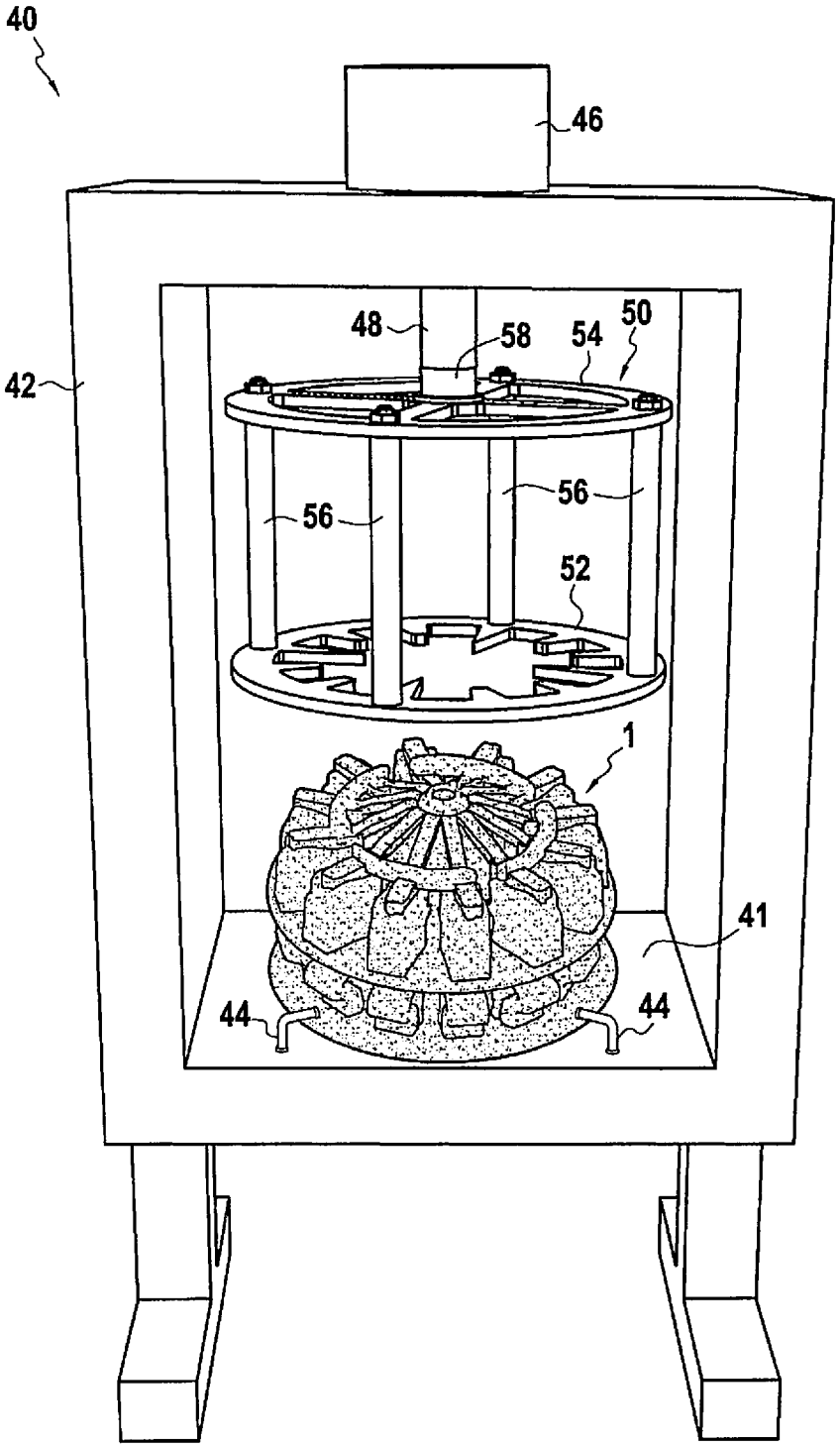
FIG. 4 is a diagrammatic perspective view of a knockout machine in a first embodiment of the invention, used for performing the method shown in FIGS. 1 to 3.

The knockout method is performed by means of a knockout machine 40 (FIG. 4).

The machine 40 comprises a frame or structure 42, tooling 50, and an actuator 46. The frame 42 has fastener tabs or tenons 44 (of the bench dog type), serving to fasten the shell mold 1 containing the blade cluster 30 securely to a perforated plate 41 of the frame 42. The perforated portions of the plate serve to pass fragments of the shell mold during the knockout operation, and they are not shown.

The tenons 44 serve to fasten the shell mold 1 in such a manner that the axis of symmetry (X) of the mold extends in the vertical direction.

The actuator 46 is a linear jack. It is arranged so as to move the tooling 50 vertically in the downward direction, along the axis X of the shell mold 1.

The tooling 50 (FIG. 6) is in the shape of a cage, with a top disk 54 and a bottom disk 52 fastened to the disk 54 by four vertical metal bars 56.

The tooling 50 is fastened to the outlet shaft 48 of the jack 46 by a sleeve 58 fastened to the outside top surface of the disk 54, in which the end of the shaft 48 is secured. The top disk 54 is thus the driven portion of the tooling 50.

The bottom disk 52 is the working portion of the tooling 50, i.e. the portion that includes the knife 64 that engages the shell mold 1 in order to knock out the blade cluster 30.

Figure 6:
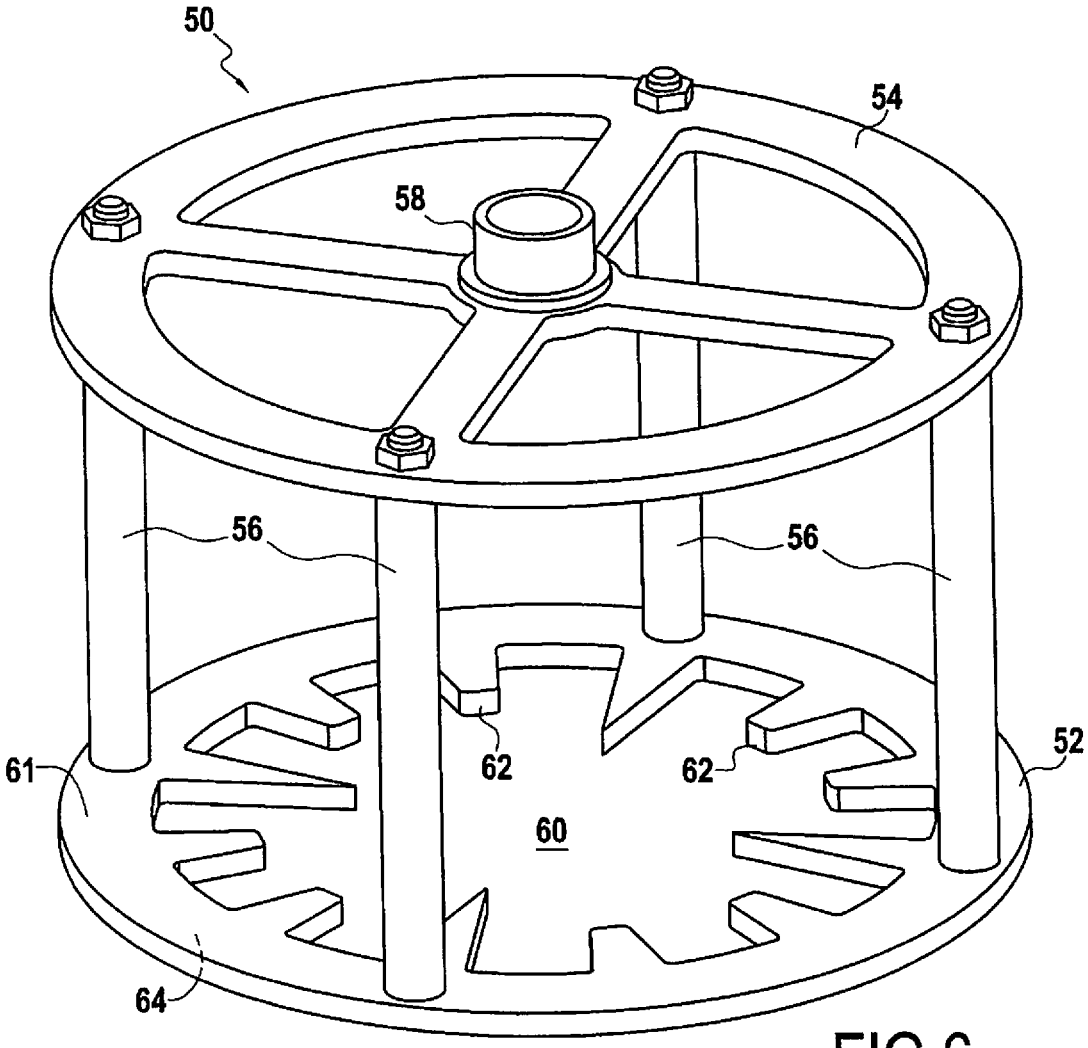
FIG. 6 is a perspective view of the tooling used in the method shown in FIGS. 1 to 5B.

The disk 52 has a large opening 60 of generally circular shape in its central portion (FIG. 6). At the periphery of this opening 60 there are provided knockout fingers 62. These fingers are disk portions that extend from the peripheral ring 61 of the disk 52 in a radially inward direction towards the axis X of the machine 40.

The bottom surface of the disk 52 (under the fingers 62 and also under the peripheral ring 61) constitutes the knife 64. This knife 64 is designed to engage the shell mold 1 when the jack 46 moves the tooling 50 downwards (arrows A, FIG. 3).

The jack 46 is designed to move the tooling 50—and thus the knife 64—in translation relative to the frame at a constant speed of less than 0.2 m/s. The choice of a fairly slow speed serves to avoid creating excessive accumulations of stresses on the casting cluster while knocking out the blades, thereby avoiding creating mechanical stresses that might generate recrystallized grains during heat treatment.

Furthermore, the knockout machine 40 is designed in such a manner that during the downward movement of the tooling 50, the jack 46 moves the knife 64 (and more generally the tooling 50) without making contact with the cluster 30, and in particular without making contact with the blades.

For this purpose, the disk 52 is arranged in such a manner that the blade cluster 30 can pass through its opening 60 without making contact.

The knockout machine 40 is designed in such a manner that during the downward movement of the tooling 50, the knife 64 engages different portions of the shell mold 1, referred to as protuberances, and detaches the major portion of the shell from the cluster 30.

In the example described, these protuberances are constituted by the additional shell portions forming the heat shields 13 and 13'.

It can thus be understood that the disk 52 is designed to come into contact with the shell mold 1 via the protuberances (the heat shields 13 and 13'). Nevertheless, the disk 52 (and thus knife 64) must not come into contact with the (metal) cluster 30.

Particular care must be given to the contact between the disk 52 and the protuberances. The protuberances are constituted by the additional portions of the shell, i.e. the heat shields 13 and 13'. Depending on the implementation, these additional portions are either empty, or else filled or partially filled with metal.

In the above-mentioned first implementation of the method, the protuberances are empty. Under such circumstances, in order to enable the disk 52 to move downwards without coming into contact with the cluster 30, it suffices for the disk 52 to engage or interfere with the additional shell portion while remaining at a sufficient safety distance from the cluster 30. Under such circumstances, the disk 52 can come largely into contact with the additional shell portions (heat shields 13 and 13').

Figure 5A:
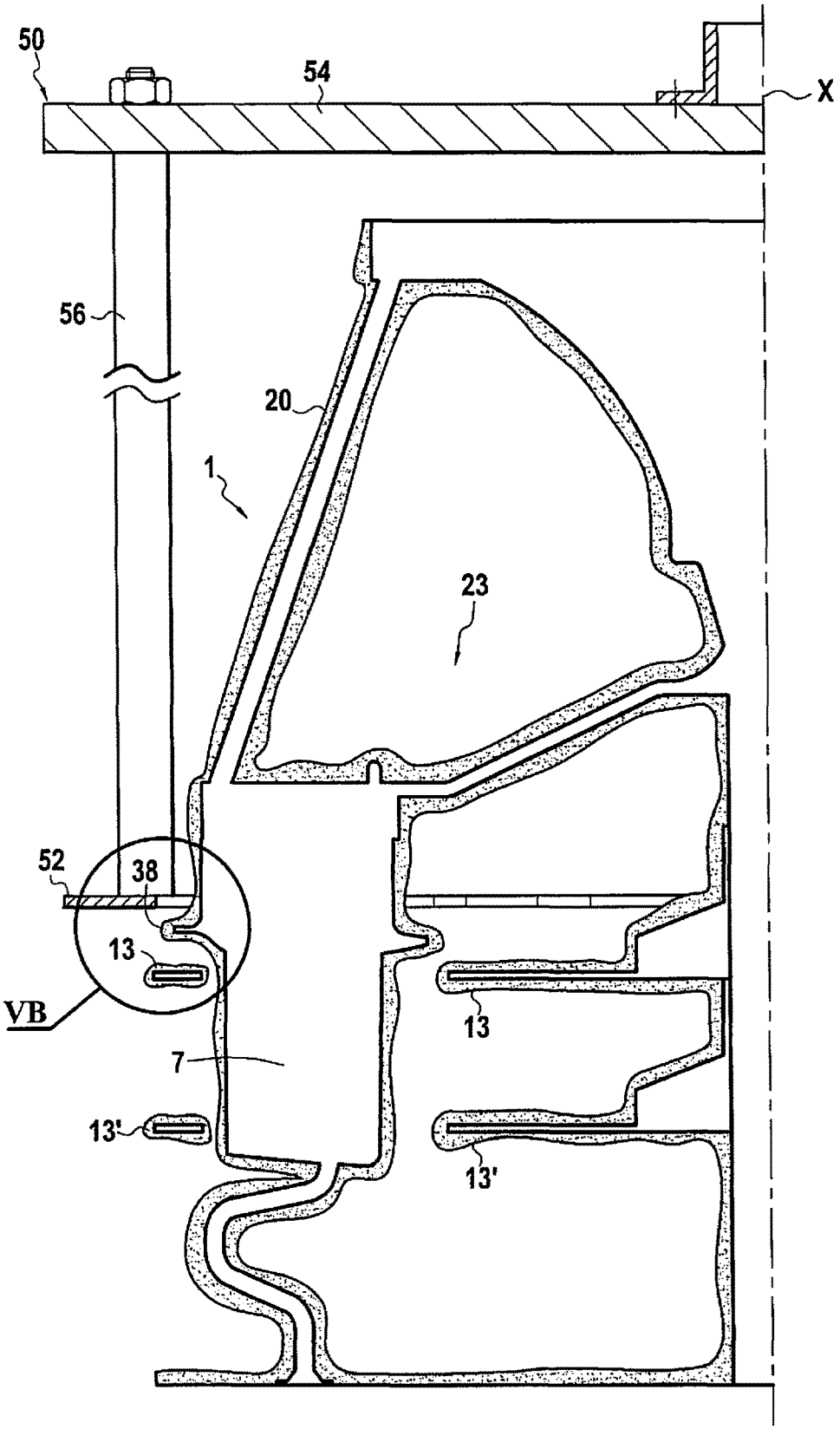
FIG. 5A is a half-view in axial section of the shell mold and of the tooling shown in FIG. 3.
Figure 5B:
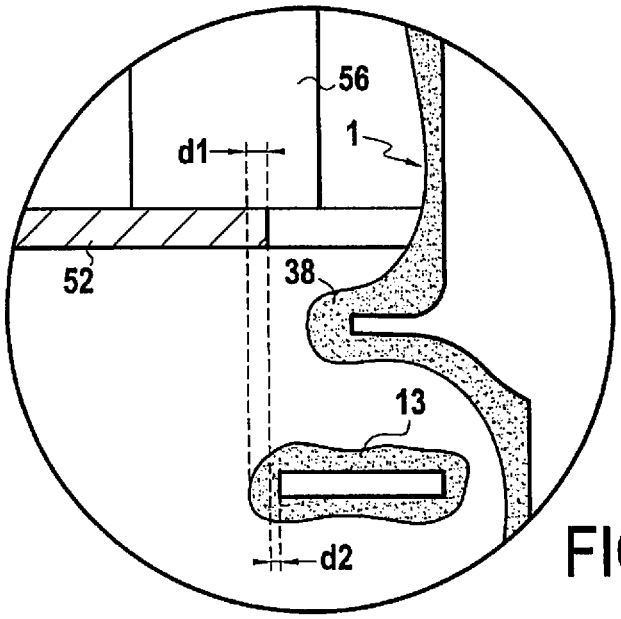
FIG. 5B shows a detail of FIG. 5A.

In the above-mentioned second implementation of the method, shown in FIG. 5B, the protuberances or heat shields 13, 13' are filled in full or in part with metal.

In this implementation, the radial interference zone between the disk 52 and the heat shield 13 can extend over only a small distance d1 between the disk 52 and the shell mold 1. The path followed by the disk 52 is designed to ensure that there is no contact under any circumstances between the disk and the cluster 30; for this purpose, a safety distance d2 is provided lying at all times between the disk 52 and the cluster 30.

Furthermore, the shape of the disk 52 is designed in such a manner that contact between the disk and the shell mold takes place initially via the top heat shield 13. This implies in particular that the disk 52 is arranged conversely so as not to come into contact with the mold portions 1 that are situated above the heat shield 13, such as in particular the top projections 38 of the shell mold 1 (FIG. 5B).

The shield 13 constitutes a "protuberance" that the knife 64 engages while the tooling 50 is being moved in accordance with the invention; this does not apply to the projections 38.

Advantageously, since the heat shield 13 is situated at a certain distance from the blades, the mechanical stresses applied to the blades during contact between the knives 64 and the shell mold are relatively small and do not create zones that might create recrystallized grains.

When the tooling 50 moves downwards under the action of the jack 46, the disk 52 comes into contact with the shell mold 1.

The knife 64 then bears against the surface of the shield 13 (acting as a protuberance) delivering a force that tends to break the ceramic of the shell into fragments; rupture lines propagate going from the protuberance towards all of the remainder of the shell.

Thus, as the tooling 50 continues to move downwards, it strikes the shell mold 1 (at moderate speed) and continues its downward movement while exerting a force on the shell mold. The shell mold 1, which is brittle, breaks into a large number of fragments; under the effect of gravity, most of these fragments become detached from the cluster 30 and fall away. The major portion of knocking out the cluster is thus performed in a single operation that is simple and fast.

After striking the heat shield 13 constituting the top protuberance, and by continuing to move downwards, the knife 64 strikes the heat shield 13', which constitutes a bottom protuberance. It then breaks the remaining portions of the shell mold and thus finishes off knocking it out (apart from a few portions that might possibly remain).

The tooling 50 described above has the advantage of being operated using a simple movement in translation. This is made possible by the fact that the shape of the shell mold 1 enables the tooling to move past as it moves downwards in the vertical direction (axis X).

Nevertheless, a knockout machine that is more complex, in particular having different knockout tooling, might be necessary when the shape of the shell mold does not make it possible to knock out the cluster by moving tooling merely by a simple movement in translation.

Figure 7A:
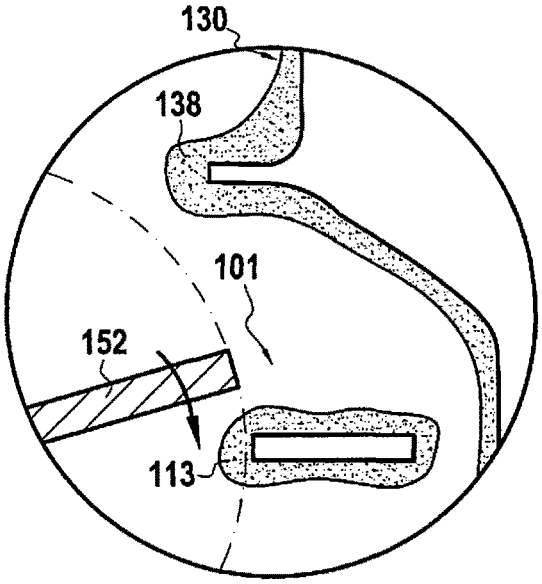
FIG. 7A is an axial section showing a detail of a shell mold containing a casting cluster, together with the tooling of a knockout machine in a second embodiment of the invention.
Figure 7B:
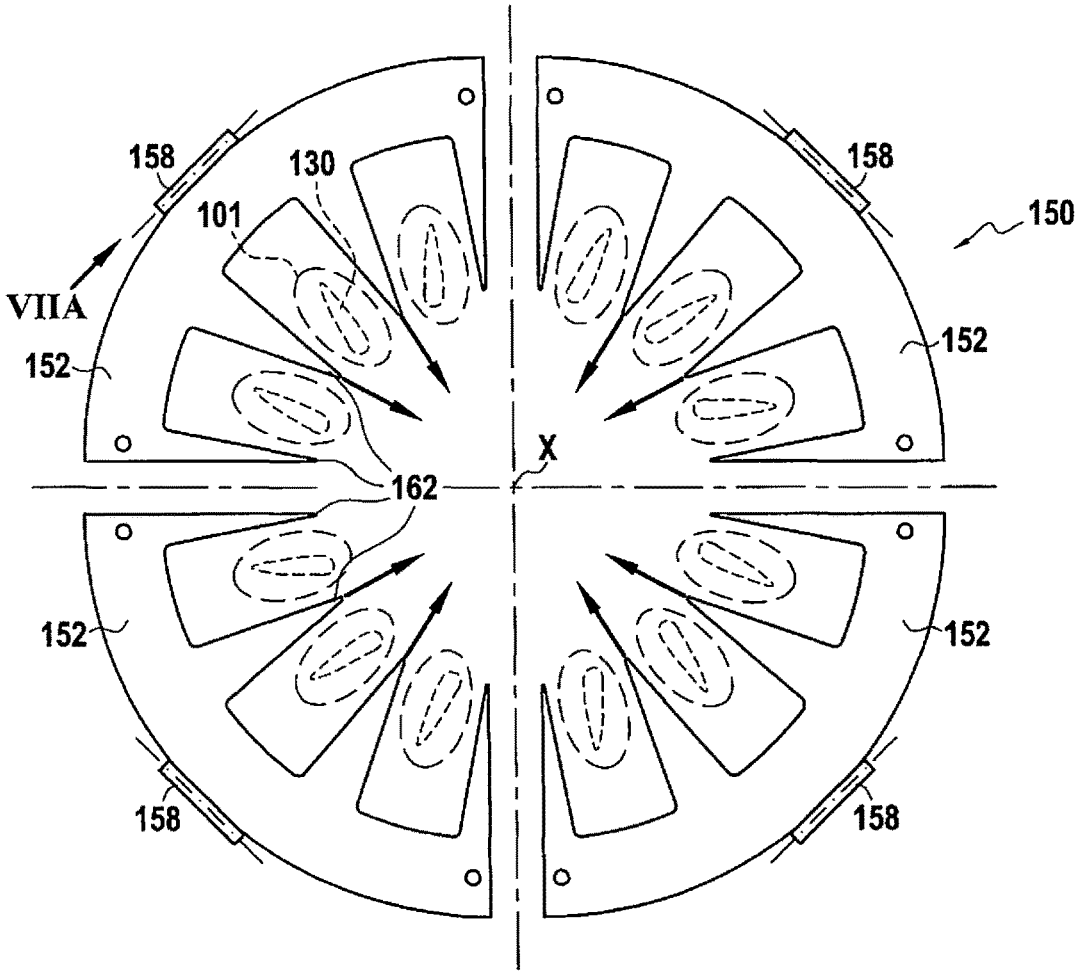
FIG. 7B is a cross-section of the tooling shown in part in FIG. 7A.
Figure 7C:
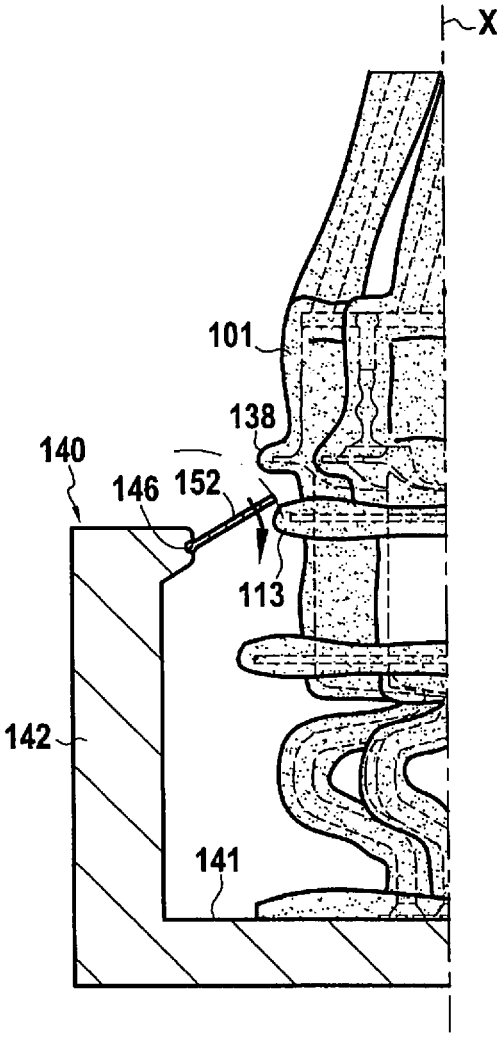
FIG. 7C is a diagrammatic axial section of the knockout machine shown in FIGS. 7A and 7B.

An example of such a situation is shown in FIGS. 7A, 7B, and 7C. In the example shown, the blades of a cluster 130 that is to be knocked out form a shell mold 101 presenting projections 138 that are very prominent. These projections 138 are incompatible with tooling moving downwards vertically without striking the shell mold 101 in register with these projections, and while also engaging the heat shield 113 (FIG. 7A).

Under such circumstances, it is therefore necessary for the tooling to move with movement that is more complex than simple movement in vertical translation.

This movement may be executed by means of a machine 140 shown in FIGS. 7B and 7C, which constitutes another embodiment of the invention.

The portions of the machine 140 or of the mold 101 that are of structure and or function identical or similar to the structure and or function of the corresponding portions of the machine 40 or of the mold 1 are given the same references as the corresponding portions, plus 100.

The knockout machine 140 comprises a frame 142 with a perforated plate 141 on which the shell mold 101 can be fastened, tooling 150, and actuators 146.

The tooling 150 is not constituted as a single rigid portion as the tooling 50, but rather as four portions (it could naturally be made using some arbitrary number of portions other than four). Each of these four portions comprises a plate 152 generally in the form of one-fourth of a disk, and these four plates are identical.

In order to move the plates 152 and consequently knock out the blade cluster, the knockout machine 140 has four rotary actuators 146 that are identical to one another. Each actuator 146 is a rotary jack suitable for turning one of the plates 152 about a horizontal axis.

For this purpose, each of the plates 152 has a flange portion 158 designed to enable the plate 152 to be fastened to a respective one of the actuators 146.

During the operation of knocking out the blade cluster 130 from the shell mold 101, the actuators 146 drive the four plates 152 to turn simultaneously. During this movement, the plates 152 engage the shell mold 101 via its top heat shield 113, thereby fragmenting the mold 101 into a large number of pieces and thus separating a large portion of the mold 101 from the blade cluster.

In another embodiment, the various portions of tooling may naturally be moved not simultaneously, but in any appropriate sequence, e.g. one after another or successively in diametrically opposite pairs, etc.

The plates 152 perform turning movements in such a manner that they do not come into contact with the cluster 130. Such turning movement enables the ends of the fingers 162 of the tooling 150 to move towards the axis X of the shell mold 101 (arrows in FIG. 7B). As a result, the fingers 162 pass between each of the pairs of adjacent blades, thereby ensuring that the shell mold 101 is fractured between all of the adjacent pairs of blades. By fragmenting the shell mold 101 in this way into at least as many fractions as there are blades 132, the tooling 150 thus ensures that a very large portion of the portions a 101 is knocked out.

Each actuator 146 is controlled in such a manner that is moves the end of the plate 152 that it drives, i.e. the end of the finger 162, at a speed that is substantially constant and less than 0.2 m/s.

Naturally, a knockout machine or method of the invention may be provided in numerous embodiments and implementations other than those described above. Numerous possibilities exist as to how the knockout knives may be arranged and how the tooling that supports them may be arranged, concerning the speeds or travel paths of the knife (or knives).

We claim:

1. A knockout method for knocking out a cluster of lost-pattern metal castings, the cluster of castings being formed in a shell, wherein at least one knife is moved by means of a machine without making contact with the cluster in such a manner that the at least one knife engages the shell, breaks it into a plurality of fragments, and detaches at least a portion of the shell from the cluster.

2. A knockout method according to claim 1, wherein said movement of said at least one knife for knocking out the cluster of castings takes place at a speed of less than 0.2 m/s.

3. A knockout method according to claim 1, wherein the movement of said at least one knife for knocking out the cluster of castings is constituted solely by a movement in translation or solely by a movement in rotation.

4. A knockout method according to claim 1, wherein the movement of said at least one knife comprises passing between every pair of adjacent castings among said castings.

5. A knockout method according to claim 1, wherein said at least one knife is constituted by a plurality of knives, and during the movement of said plurality of knives, all of said knives come into contact with the shell at substantially the same time.

6. A method of fabricating castings, the method comprising the following steps: fabricating a cluster of lost-pattern castings, the cluster of castings being formed in a shell, then knocking out at least a portion of the shell by the method according to claim 1.

7. An assembly comprising:

a cluster of lost-pattern castings, the cluster of castings being formed in a shell; and a knockout machine for knocking out the cluster of castings, the knockout machine comprising:

a frame configured to rigidly fasten the shell thereon; at least one knife; and at least one actuator suitable for moving said at least one knife relative to the frame in a space provided for fastening the cluster;

wherein the knockout machine is suitable for enabling said cluster to be fastened to the frame; and said at least one actuator is suitable, when the cluster is fastened to the frame, for moving said at least one knife relative to the cluster and without making contact with the cluster in such a manner that when the at least one knife engages the shell, the at least one knife breaks the shell into a plurality of fragments, and detaches at least a portion of the shell from the cluster.

8. An assembly according to claim 7, wherein the shell includes at least one protuberance in the vicinity of each casting of the cluster, and wherein said at least one knife engages the at least one protuberance during said movement.

9. An assembly according to claim 8, wherein the at least one protuberance includes a plurality of protuberances, and wherein said plurality of protuberances are arranged substantially in a plane.

10. An assembly according to claim 8, wherein the at least one protuberance includes a plurality of protuberances, and wherein at least some of said plurality of protuberances are formed around or from a part in the form of a plate perforated by holes.

11. An assembly according to claim 7, wherein said at least one actuator is suitable for moving said at least one knife relative to the frame at a speed less than 0.2 m/s.

12. An assembly according to claim 7, wherein said at least one actuator includes an actuator suitable for moving said at least one knife for knocking out the cluster of castings solely by a movement in translation or solely by a movement in rotation.

* * * * *